United States Patent [19]

McGuigan

[11] 4,398,767

[45] Aug. 16, 1983

[54] PATIO SWING

[76] Inventor: Richard M. McGuigan, 8642 Keystone Dr., Omaha, Nebr. 68134

[21] Appl. No.: 320,679

[22] Filed: Nov. 12, 1981

Related U.S. Application Data

[63] Continuation of Ser. No. 48,465, Jun. 27, 1979, abandoned.

[51] Int. Cl.[3] ..... A47D 13/10

[52] U.S. Cl. ..... 297/280; 5/130; 272/85; 297/281

[58] Field of Search ..... 211/182; 297/279, 277, 297/278, 280, 281; 5/127, 130, 100, 103, 106; 272/85; D21/246

[56] References Cited

U.S. PATENT DOCUMENTS

| | | | |
|---|---|---|---|
| D. 241,047 | 8/1976 | Ryan | D21/246 |
| 857,653 | 6/1907 | McCauley | 297/280 |
| 868,640 | 10/1907 | Busch | 297/77 |
| 1,192,046 | 7/1916 | Freeble et al. | 297/280 |
| 1,475,512 | 11/1923 | Rice et al. | 297/280 |
| 2,919,149 | 12/1959 | Farley | 211/182 X |
| 3,391,795 | 7/1968 | Finlayson | 211/182 X |
| 3,528,657 | 9/1970 | Krupsky | 272/85 |
| 3,593,352 | 7/1971 | Britt | 5/127 |
| 4,288,937 | 9/1981 | Virsen | 211/182 X |

*Primary Examiner*—James T. McCall
*Attorney, Agent, or Firm*—Hiram A. Sturges

[57] ABSTRACT

A patio swing comprising a seat suspended between right and left upright side supports, the right and left side supports being stably supported on feet members and being rigidly interconnected below the seat by a bridging assembly, the side supports inclining inwardly at their upper ends.

11 Claims, 4 Drawing Figures

PATIO SWING

This application is a continuation of the applicant's co-pending patent application Ser. No. 048,465, filed June 27, 1979 and titled PATIO SWING, now abandoned.

BACKGROUND OF THE INVENTION

There has long been a need for a portable swing which is safe, economical to construct, and attractive.

The inward inclination of the arches of the side supports of this invention provides for good swinging action with a minimum side support height. This also provides more clearance between the swing seat and the side supports. This inclination also causes the swing seat to pull the side supports inwardly with much less pressure than there would be if the side supports were not bent.

Although the patio swing of this invention is of an exceptionally sturdy construction, it also has a number of very economical attributes. The arch of the side supports is easily and economically constructed by the use of pipe bending equipment.

The cost of the patio swing is also lowered by the fact that the bridge structure is of sufficiently strong construction to maintain the side supports in place without the expense, as well as the unsightliness, of an overhead interconnection between the side supports. The assembly and material costs of the swing are lessened considerably in this way.

The roundness of the upright portions of the arches of the side supports also gives this invention an attribute of safety. Parents need no longer worry about children colliding with sharp or pointed edges of the swing.

Experiment has shown that side supports having a height of 57 inches and constructed of a pipe having a one inch outside diameter, and a ¾ inch inside diameter, work very well in combination with a swing seat six feet long, constructed of wooden boards which are approximately six inches wide by two inches deep. In addition, the materials used should be such that their weight keeps the swing from tipping over when it is in use.

The saftey of this swing is furthur increased by feet attached to the bottom of the legs. The feet help to keep the swing stable on the ground, and not allowing it to tip over, even when the swing is strongly moving forward and backwards.

Because this swing does not need to be attached to anything before it can be put to use, it becomes very useful in many situations where it would be difficult, or even impossible, and always a nuisance, to attach the swing to a stationary object. This feature also allows the swing to be moved easily to different locations whenever it may be found necessary or convenient to do so.

The curved arches of the swing supports of this invention make the swing attractive as well as safe and economical.

This invention does away with the unsightly height so often associated with many swings of the past. This feature makes the swing less bulky and more attractive.

Another advantage is the inexpensiveness of the side pipes. The arched pipes are both inexpensive and strong enough for their intended use.

The two bolts which hold the attaching member to the bridge are widely spaced. In addition, the attaching members are welded to the bridge over broad areas. This combination is such that the bolts will not collapse at the bridge, even when several heavy people are using the swing at the same time.

SUMMARY

A major objective of this invention is to provide a patio swing comprising a swing seat suspended between right and left upright side supports, the right and left side supports being stably supported on feet members and being rigidly interconnected below the seat by a bridging assembly, the side supports inclining inwardly at their upper ends.

A further objective of this invention is to provide attractive, economical side supports made of pipe bent into arches, the roundedness of the upright portions of the arches providing saftey when a child collides with them.

Yet another objective is to provide an economical bridging assembly formed substantially of angle iron.

DESCRIPTION OF THE PREFERRED EMBODIMENT

Figure 1:
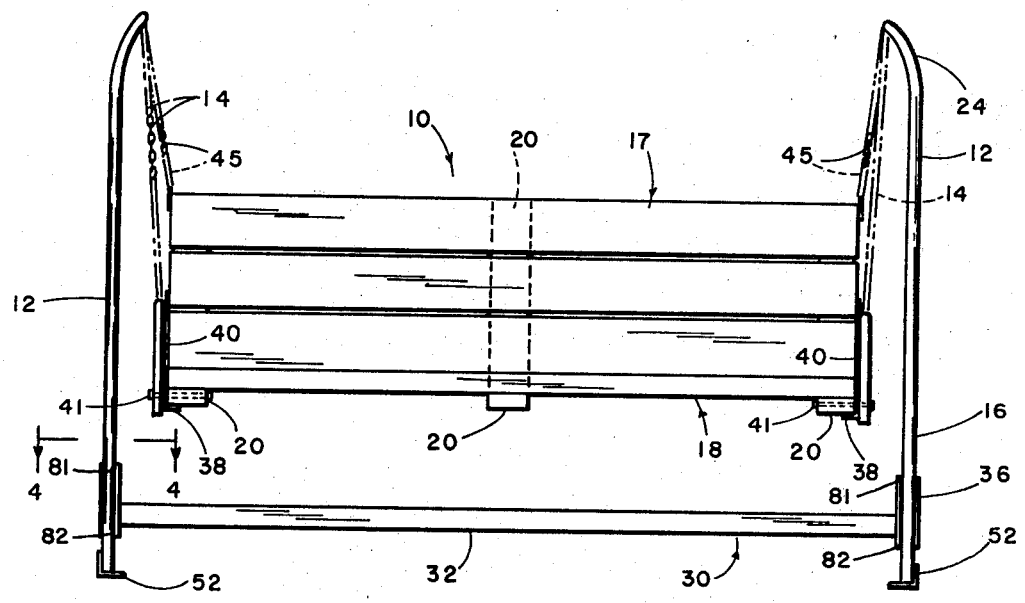
FIG. 1 is a frontal elevation of the patio swing showing a seat suspended between two side supports.
Figure 2:
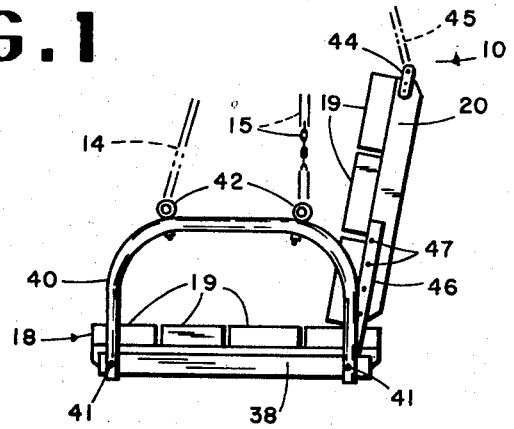
FIG. 2 is a side elevation of the swing seat alone.

Referring to FIG. 1, a seat 10 is shown as being suspended from upright side support assemblies 12 by means of arm rest suspenders 14, arm rest suspenders 15, as seen in FIG. 2, and back portion suspenders 45, and comprises a back portion 17, a horizontal bottom portion 18, and reinforcing supports 20 which run transverse to both the back boards 16 and the seat boards 18.

The side support assemblies 12 are each a U-shaped member having forward and rearward upwardly extending post portions 16 connected by an upper bight portion 24 which can also be called an upper end portion 24 of the side support assemblies 12 are inclined inwardly so that suspenders are held away from the side support assembly 12. This provides for a good swinging action with a minimum side support height.

The upper bight portions 24 each incline inwardly toward a place disposed above the center of the seat 10, whereby right and left support points 25 are provided at the centers of the bight portions, such support points 25 are inwardly offset from the upright post portions 16.

The back boards 16 are disposed in a plane which is almost vertical and which faces forwardly, whereby as later described, the seat 10 swings in an arc forwardly and rearwardly with respect to the posts 16.

Figure 3:
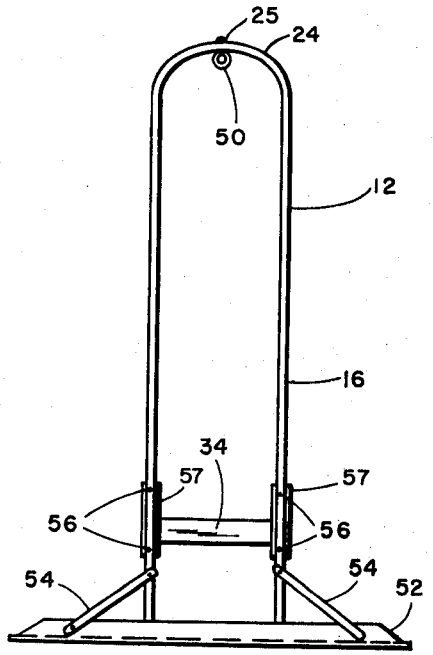
FIG. 3 is a side elevation of the patio swing without a swing seat or seat suspenders or a left side support. The right side support is shown in connection with the bottom bridging assembly.

Each post portion 16 of each side support assembly 12 is attached to a bottom assembly 30 comprising first angle or first frame members 32 extending parallel to the length of the seat 10, both in front of and behind the seat, second angle irons, not seen in this view, but indicated at 34 of FIG. 3, attaching members 36 extending substantially vertical, and substantially at a right angle to both the first and second angle irons or first and second horizontal frame members 32 and 38 respectively, and is used to hold the side support assembly 12 stable, and is ridgedly secured to the bottom assembly 30 by welding.

As thus described, it will be seen that the bottom assembly 30 has at least one and preferably two horizontal first frame members 32 extending from right to left under the seat 10. Each of the attaching members 36 that is closest to a respective upright post portion 16 is in contact with the respective upright post portion 16 all along the length of the respective attaching member 36 as the result of the effect of the bolts 56. However, each upright post 16 is in contact with the adjacent attaching member 36 at at least two points at the bottom and top of the respective attaching member 36, such two points being indicated in FIG. 1 at 81 and 82. The two points 81 and 82 are spaced apart with respect to each other a distance substantially greater than the average vertical dimension of either one of the first frame members 32, as best seen in FIG. 1, for strong support of the respective upright post portion 16 so that an economically light post portion will be strong enough.

Arm rests 40 are held to the seat 10 by means of a bolt 41 extending through the arm rest 40, an angle iron 38, and a reinforcing support 20.

In FIG. 2 the seat 10 is seen to have an arm rest 40 having suspender hooking assemblies 42 attached to the top thereof, and being connected to an angle iron 38 attaching to the reinforcing support, 20 of FIG. 1, by means of a bolt 41. Another suspender hooking assembly 44, is shown to be attached to a reinforcing support 20.

Seat protectors 46 are shown to be connected to the sides of the seat 10, by connecting members 47, and are for the purpose of protecting the sides of the seat if it should come in contact with the side support assembly, 12 of FIG. 1.

The bottom portion 18 and the back portion, 17 of FIG. 1, are seen in FIG. 2 as comprising respectively four and three boards 19 being substantially five and $\frac{3}{4}$ inches by one and $\frac{5}{8}$ inches.

In FIG. 3, the side support assembly 12 is shown to be in the shape of an arch. At the uppermost point in the side support assembly is a suspender hooking assembly 50 from which the suspenders 14, 15, and 45 extend. The lower portion 16 of the side support assembly 12 is shown to be held together by a second angle iron 34.

The side support assembly furthur comprises feet 52 attaching at the bottom of the side support assembly 12, by means of connecting slats 54.

Two widely spaced bolts 56 are used to help hold together the attaching members 57 and the lower end portion of the side support assembly 16.

Figure 4:
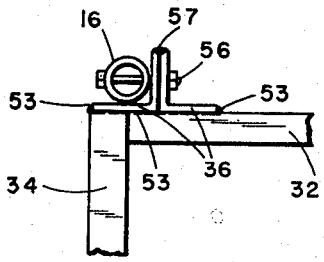
FIG. 4 is a sectional view on the line 4—4, showing only the left rear corner to illustrate the connection of a right side support upright with the bottom bridging assembly.

FIG. 4 is a sectional view along line 4—4 of FIG. 1, showing only the left rear corner of the patio swing. The lower portion of the right side support assembly 16 is fitted to an attaching member 36, and is held thereto by means of a second bolt 56, the end of which is also seen in FIG. 3. The attaching member is furthur secured to to the side supporting assembly by a welding 53.

The attaching member may consist of a single angle iron fitted to the side support assembly 12. A modification of the attaching member as seen at 36 of FIG. 4, would be two angle irons adjacent to each other, both being connected to the first angle iron 32, and one being connected to both the first angle iron 32 and the second angle iron 34.

I claim:

1. A patio swing comprising a frame, a seat having a substantially horizontal lower portion and an upwardly extending back portion, said frame comprising right and left elongated upright side support assemblies at the right and left sides of said seat respectively, and extending higher than said seat, said side support assemblies each having lower end portions extending below said seat, a bottom assembly connecting said lower portions of said side support assemblies, each side support assembly having forward and rearward upright post portions, said side support assemblies each having an upper end portion, a flexible suspending means connecting said upper end portions of said right and left side supports to right and left sides of said seat whereby said seat swings in an arc forwardly and rearwardly with respect to said posts, right and left upper supporting means attached to said right and left side supports respectively and having thereon right and left support points respectively, said right and left support points being disposed inwardly toward the center of said seat from said right and left side supports respectively, said flexible suspending means being connected to said right and left support points respectively, said seat being substantially spaced from said posts for avoiding collisions therewith during swinging, said side support assemblies each being a U-shaped member having forward and rearward upwardly extending post portions connected by an upper bight portion inclined inwardly toward a place disposed above the center of said seat whereby said right and left support points are on said bight portions and said support points are offset inwardly from said post portions.

2. The patio swing of claim 1 having said upper portions of said side support assemblies being inclined inwardly.

3. The patio swing of claim 1 having right and left arm rests on the right and left sides respectively of said seat, said arm rests each being formed of a single piece of material of an inverted U shape, means connecting said arm rests to said seat.

4. The patio swing of claim 1 having said lower seat portion being formed of wood, right and left metallic seat protectors attached to the right and left sides respectively of said seat, said seat protectors being formed of angle iron and having horizontal portions extending under respective edges of said seat bottom portion, said arm rests being connected to said seat protectors.

5. The patio swing of claim 3 having said flexible suspending means comprising said arm rests and first right and left and second right and left suspenders attaching upper portions of respective side supports to two points of said arm rests respectively, said points being spaced forwardly and rearwardly of each other.

6. The patio swing of claim 3 having said flexible suspending means comprising right and left seat back portion suspenders connecting respective right and left side support assembly upper portions to respective sides of said seat back portion.

7. The patio swing of claim 1 having said side support assemblies having a hollow pipe in an inverted U shape providing front and back upright portions.

8. The patio swing of claim 7 having said side support assembly pipes being steel pipes each having substantially the strength of a steel pipe having a one inch outside diameter and a $\frac{3}{4}$ inch inside diameter.

9. The patio swing of claim 1 comprising said bottom assembly being connected to said side support assembly by means of four attaching members bolted to lower end portions of said support assembly upright post portions respectively, said attaching members being ridgedly secured to said bottom assembly.

10. A patio swing comprising a frame, a seat having a substantially horizontal lower portion and an upwardly extending forwardly facing back portion, said frame comprising right and left elongated upright side support assemblies at the right and left sides of said seat respectively, and extending higher than said seat, said side support assemblies each having lower end portions extending below said seat, a bottom assembly connecting said lower portions of said side support assemblies, each side support assembly having forward and rearward upright post portions, said side support assemblies each having an upper end portion, a flexible suspending means connecting said upper end portions of said right and left side supports to right and left sides of said seat whereby said seat swings in an arc forwardly and rearwardly with respect to said posts, right and left upper supporting means attached to said right and left side supports respectively and having thereon right and left support points respectively, said right and left support points being disposed inwardly toward the center of said seat from said right and left side supports respectively, said flexible suspending means being connected to said right and left support points respectively, said seat being substantially spaced from said posts for avoiding collisions therewith during swinging, said bottom assembly being connected to said side support assembly by means of four attaching members bolted to lower end portions of said support assembly upright post portions respectively, said attaching members being ridgedly secured to said bottom assembly, said bottom assembly comprising at least one substantially horizontal first frame member extending from right to left under said seat, each of said attaching members being in contact with its respective upright post portion at at least two points, said two points being vertically spaced with respect to each other a distance substantially greater than the average vertical dimension of said first frame member for strong support of the respective upright post portion so that economically light post portions will be strong enough.

11. A patio swing comprising a frame, a seat having a substantially horizontal lower portion and an upwardly extending back portion, said frame comprising right and left elongated upright side support assemblies at the right and left sides of said seat respectively, and extending higher than said seat, said side support assemblies each having lower end portions extending below said seat, a bottom assembly connecting said lower portions of said side support assemblies, each side support assembly having forward and rearward upright post portions, said side support assemblies each having an upper end portion, a flexible suspending means connecting said upper end portions of said right and left side supports to right and left sides of said seat whereby said seat swings in an arc forwardly and rearwardly with respect to said posts, right and left upper supporting means attached to said right and left side supports respectively and having thereon right and left support points respectively, said right and left support points being disposed inwardly toward the center of said seat from said right and left side supports respectively, said flexible suspending means being connected to said right and left support points respectively, said seat being substantially spaced from said posts for avoiding collisions therewith during swinging, said upright post portions being connected by interconnection means, an intermediate part of each of said interconnection means being adjacent said right and left support points, at least parts of each of said interconnection means lying along straight lines inclining downwardly and outwardly toward respective upright post portions, said swing being free of rigid frame means interconnecting the upper ends of said right and left upright side support assemblies.

* * * * *